United States Patent [19]

Bode, Jr. et al.

[11] 4,131,220

[45] Dec. 26, 1978

[54] POUR TUBE MANIPULATOR FOR SLIDING GATE VALVE

[75] Inventors: Charles H. Bode, Jr., Bethel Park; Anthony S. Saggio, Pittsburgh; George J. Wagner, Jr., McDonald; Richard L. Wessel, Plum Borough, all of Pa.

[73] Assignee: United States Steel Corporation, Pittsburgh, Pa.

[21] Appl. No.: 874,724

[22] Filed: Feb. 3, 1978

Related U.S. Application Data

[63] Continuation of Ser. No. 763,187, Jan. 27, 1977, abandoned.

[51] Int. Cl.[2] ..... B22D 41/08

[52] U.S. Cl. ..... 222/607; 164/337

[58] Field of Search ..... 164/82, 437, 337; 222/591, 598, 600, 601, 602, 606, 607

[56] References Cited

U.S. PATENT DOCUMENTS

| | | | |
|---|---|---|---|
| 2,143,758 | 1/1939 | Broms | 222/607 |
| 3,743,007 | 7/1973 | Simons et al. | 222/600 X |
| 3,884,400 | 5/1975 | Tuschak | 222/607 |
| 3,907,022 | 9/1975 | Simons et al. | 164/82 |
| 4,079,869 | 3/1978 | Meier et al. | 222/607 X |

FOREIGN PATENT DOCUMENTS

| | | | |
|---|---|---|---|
| 567533 | 8/1960 | Belgium | 222/592 |
| 502705 | 4/1972 | U.S.S.R. | 222/607 |

*Primary Examiner*—David A. Scherbel
*Attorney, Agent, or Firm*—John F. Carney

[57] ABSTRACT

Pour tubes for use in conjunction with slidable gate valves that regulate the flow of molten metal from the pour opening in a bottom pour teeming vessel are operatively positioned with respect to the gate valve collector nozzle by means of mounting apparatus of particular construction. A pouring tube is replaceably positioned in the apparatus which is operative to manipulate the tube within a confined space into its operating position with respect to the collector nozzle between the teeming vessel and a receiving vessel.

15 Claims, 11 Drawing Figures

FIG. 6
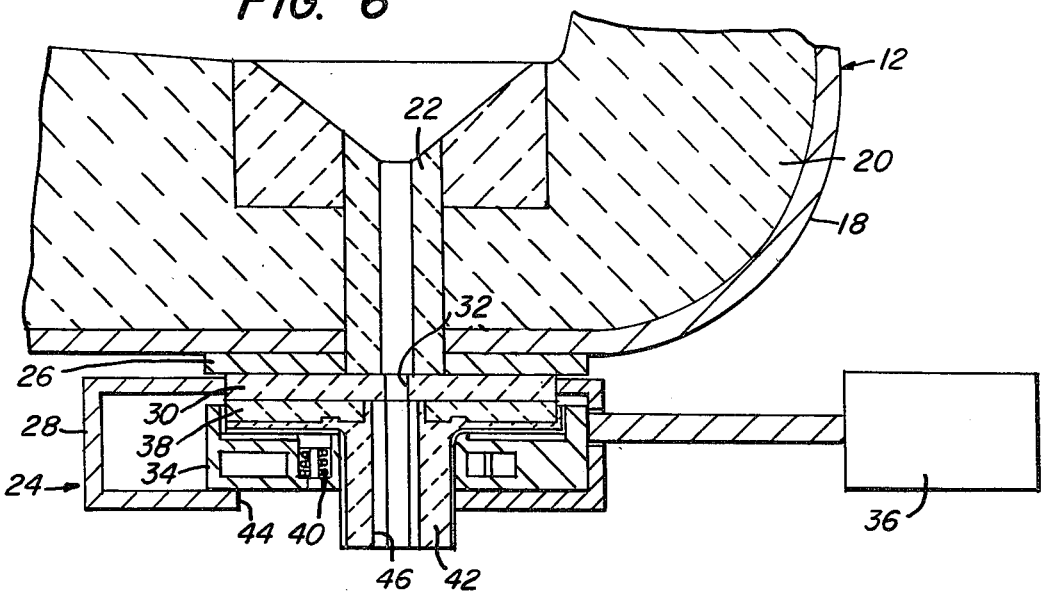
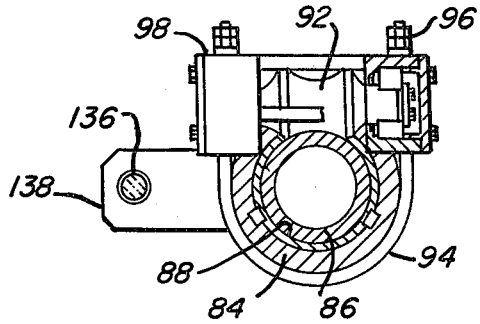
FIG. 8
FIG. 7
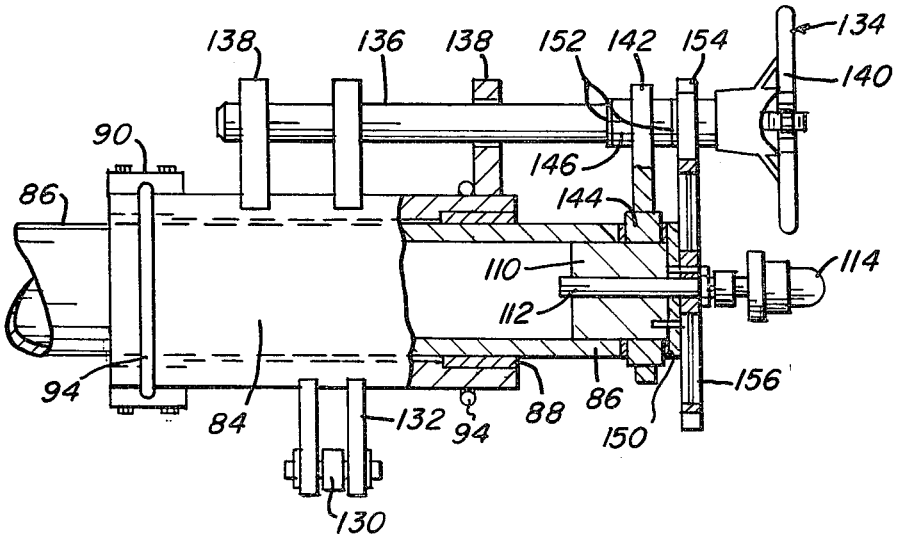

POUR TUBE MANIPULATOR FOR SLIDING GATE VALVE

This is a continuation of application Ser. No. 763,187, filed Jan. 27, 1977 now abandoned.

BACKGROUND OF THE INVENTION

This invention relates to an improved mechanism for replaceably supporting a submerged pouring tube with respect to the pour opening of a bottom pour vessel equipped with a slidable gate closure.

Bottom-pour teeming vessels are often equipped with slidable gate closures for controlling the discharge of liquid metal from the pour-openings thereof. Such closures may be used on tundishes from which metal is teemed into continuous casting molds as well as on ladles, degassing vessels and the like.

It is usually desirable when pouring molten metal to protect the metal against oxidation caused by its exposure to air as it is poured from the teeming vessel to the receiving vessel. In some applications, such as the pouring of aluminum killed steels, such protection is imperative. Protection against oxidation is normally accomplished by confining the metal flow stream within an elongated refractory pour tube that extends from the pour opening of the teeming vessel and has its lower end submerged below the level of the liquid metal in the receiving vessel. Apparatus of this type is shown and described in U.S. Pat. No. 3,501,068 to J. T. Shapland and assigned to the assignee herein.

The use of submerged pouring tubes in association with slidable gate closures is known but their use has been characterized by a significant disadvantage in that the tubes are subject to erosion and other deterioration and must be replaced frequently. Replacement of the tubes in prior art applications, such as are disclosed in U.S. Pat. No. 3,727,805 to J. T. Shapland and U.S. Pat. No. 3,907,022 to W. Simons et al, are generally unreliable and expose personnel required to make the change to extreme heat and the danger attendant with having to work close to hot metal.

It is to the improvement of such apparatus, therefore, that the present invention is directed.

SUMMARY

According to the present invention, there is thus provided means for mounting a pour tube in operative relation to the pour opening in a bottom-pour teeming vessel comprising a stationary base, vertically extensible and retractable mast means upstanding from said base, journal means attached to said mast means adjacent the upper end thereof, an elongated arm mounted in said journal means for rotation about the longitudinal axis of said arm and for relative axial movement with respect to said journal means, said arm having means adjacent the free end thereof for releasably attaching a pouring tube, means for selectively rotating said arm abouts its longitudinal axis, and means for selectively adjusting the axial position of the pouring tube attaching means with respect to said base.

It is therefore a principal object of the invention to provide an improved pouring tube support apparatus which permits the removal and replacement of pouring tubes with respect to the pour opening of bottom-pour teeming vessels without disturbing other parts of the assembly and without danger to the workman.

It is a further object of the invention to provide apparatus of the described type that permits removal and replacement of pouring tubes independently of slidable gate valves with which the pouring tubes cooperate.

It is another object of the invention to provide apparatus of the described type that permits ready removal and replacement of pouring tubes within the confined space between a bottom-pour teeming vessel and a closely subjacent receiving vessel.

For a better understanding of the invention, its operating advantages and the specific objectives obtained by its use, reference should be made to the accompanying drawings and description which relate to a preferred embodiment thereof.

DESCRIPTION OF THE DRAWINGS

FIG. 6 is a partial sectional view taken along line 6—6 of FIG. 2;

FIG. 7 is a plan view partly in section of the rear end portion of the mounting apparatus;

FIG. 8 is a sectional view taken along line 8—8 of FIG. 7;

DESCRIPTION OF A PREFERRED EMBODIMENT

Figure 2:
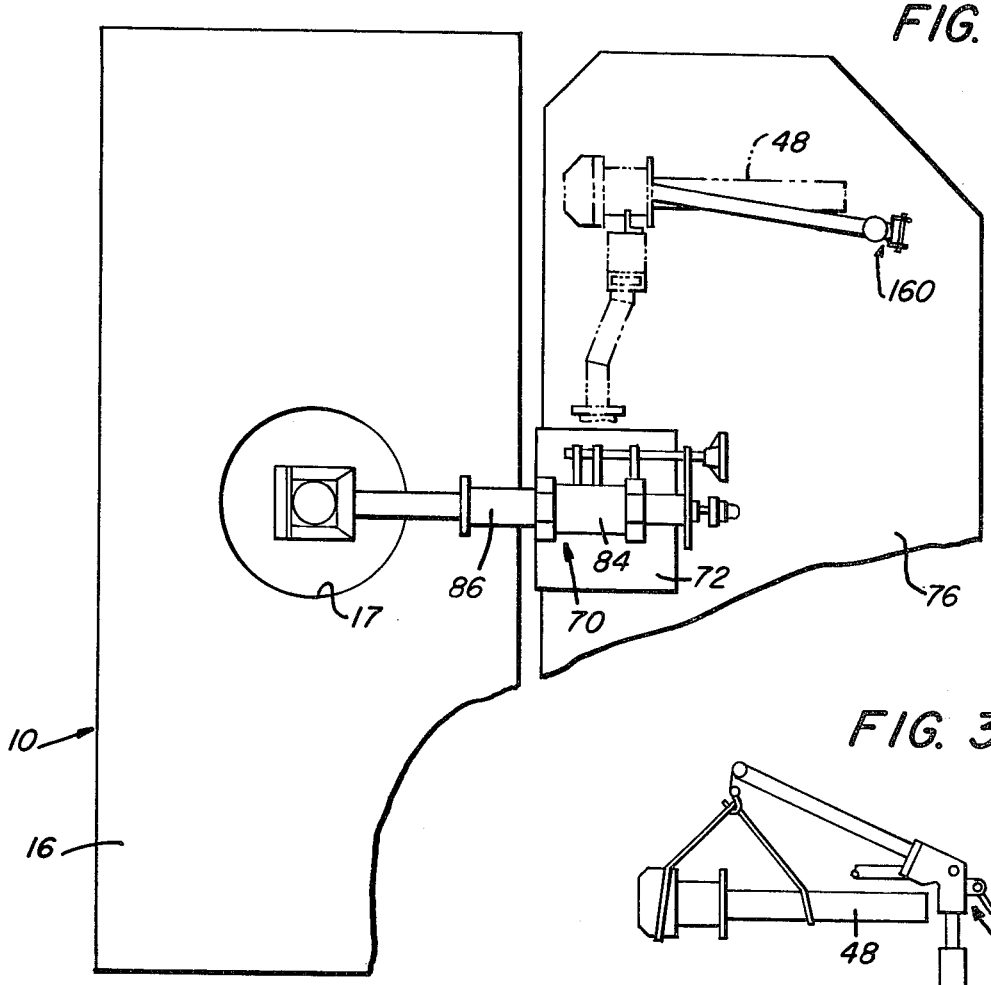
FIG. 2 is a plan view taken along line 2—2 of FIG. 1.

In the drawings, there is illustrated a receiving vessel, here shown as tundish 10, shown in operative position beneath a bottom-pour teeming vessel 12. The tundish 10 includes a horizontally elongated shell 14 having an open upper end and containing a refractory lining 15. The upper end of the tundish 10 is closed by a cover 16 containing a central through-opening 17. The teeming vessel 12, only a part of which is shown, is of conventional construction and, as shown in FIG. 6, comprises a shell 18 having a refractory lining 20 and provided in the bottom with a pour opening defined by cylindrical refractory nozzle 22. A slidable gate valve assembly of known construction, indicated generally as 24, is attached to the bottom of the shell 18 and is operative to control the flow of molten metal from the shell 12 through the pour opening.

The gate valve assembly 18 is shown in FIG. 6 as comprising a mounting plate 26 fixed to the bottom of the shell 10 in surrounding relation to the nozzle 22. Affixed to the mounting plate 26 by bolts (not shown) or the like is a slide gate housing 28 that positions a stationary refractory top plate 30 containing a through-opening 32 in alignment with the pour opening defined by the nozzle 22. A tray 34 is slidably mounted within the housing 28 for back-and-forth reciprocatory movement effected by an appropriate drive, here shown as fluid motor 36. A refractory slide plate 38 is mounted on tray 34 and is urged by spring-biased plungers 40 into pressure abutting relation to the undersurface of the top plate 30. The slide plate 38 contains a downwardly projecting collector nozzle 42 that extends through an elongated opening 44 in the bottom face of the housing 28. An opening 46 through the slide plate 38 and collector nozzle 42 is adapted, when aligned with the opening 32 in the top plate 30, to pass molten metal from the vessel 12. When the tray 34 is extended to its forward position as shown in the drawing, the openings 44 and 32 are placed in disalignment whereby the flow passage defined thereby is closed.

Figures 4, 5, 11:
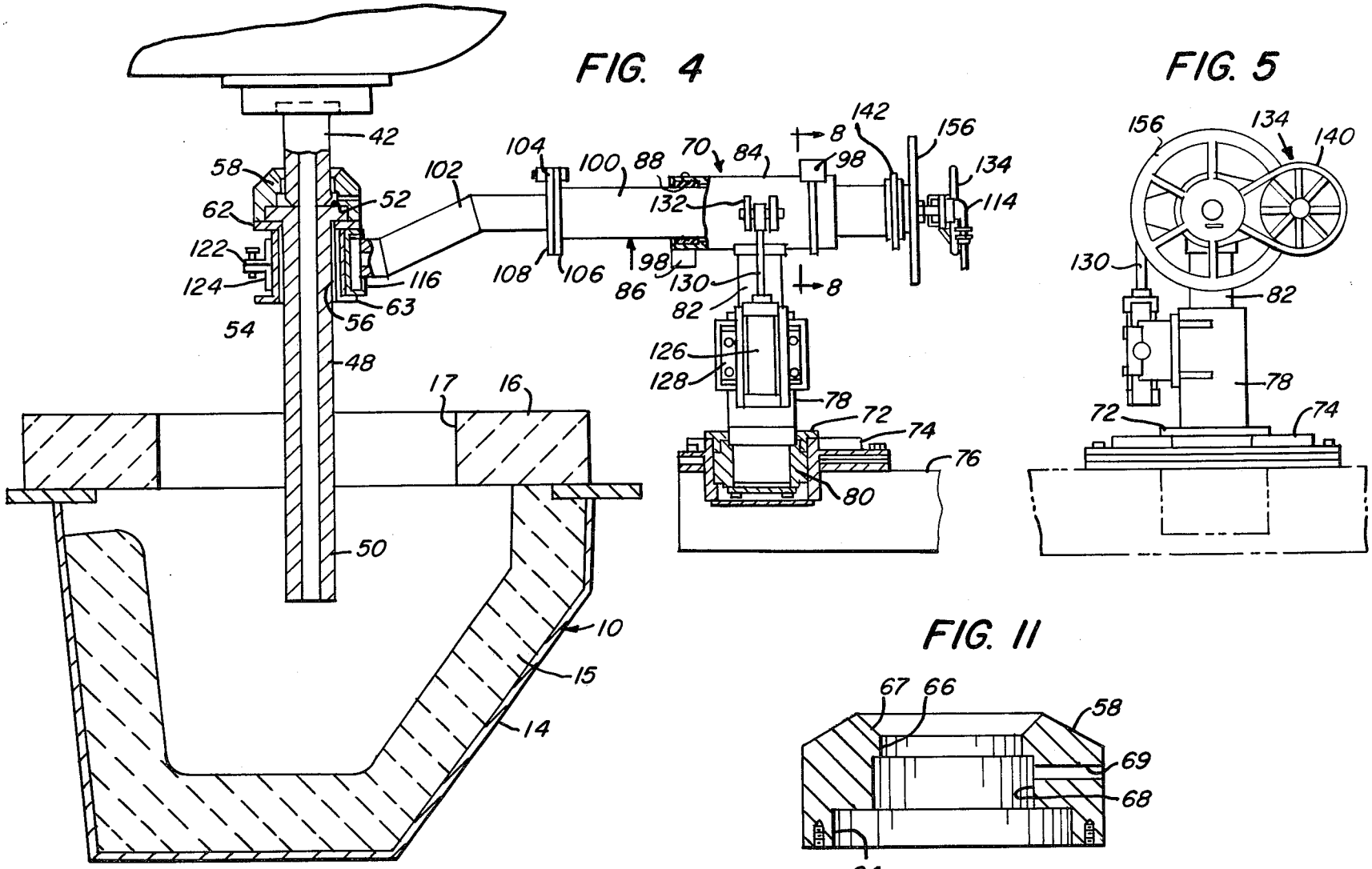
FIG. 4 is a somewhat enlarged view similar to FIG. 1 illustrating the pour tube in its operative position.
FIG. 5 is an end view taken along line 5—5 of FIG. 4.
FIG. 11 is a sectional view of the pour tube guide.
Figure 9:
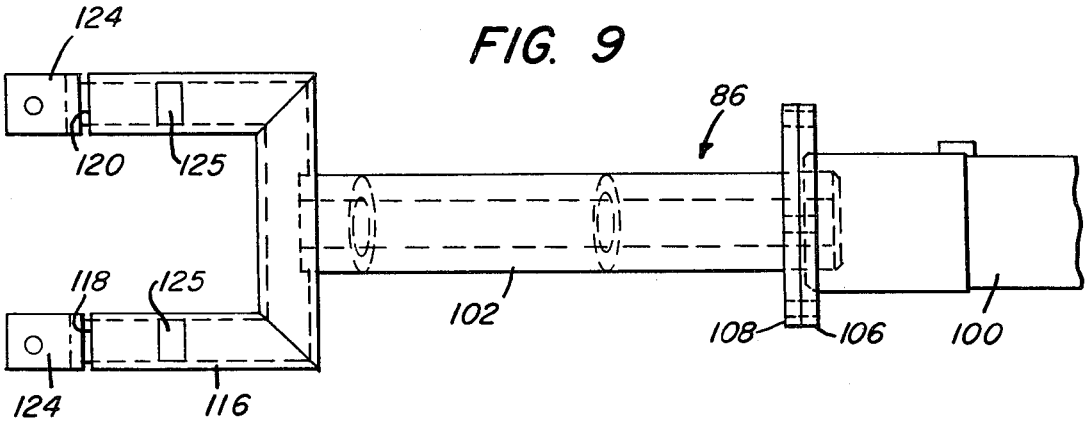
FIG. 9 is a plan view of part of the support arm portion of the mounting apparatus.
Figure 10:
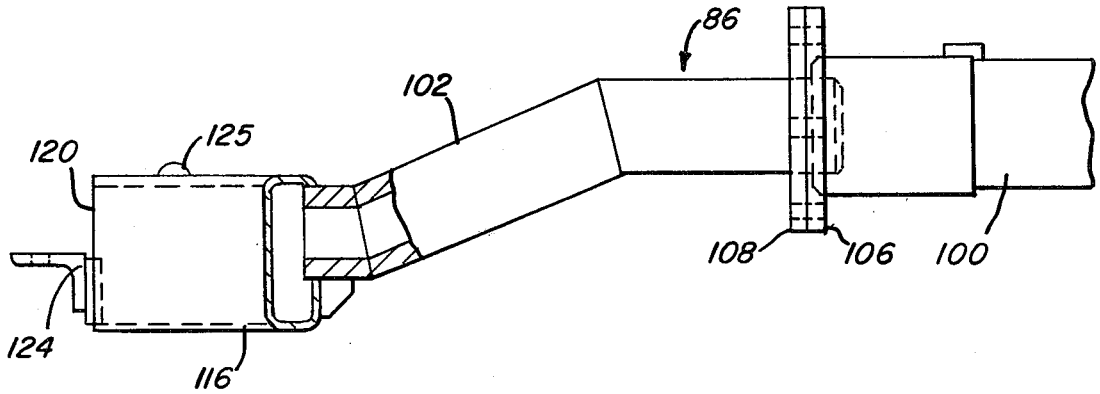
FIG. 10 is an elevational view of the support arm of FIG. 9.

A submerged pouring tube 48 is adapted for connection to the collector nozzle 42. This tube 48 extends into the interior of the tundish 10 and serves to protect the flow of molten metal from the affects of oxidation. As shown, the pouring tube comprises an elongated hollow, cylinder having an axial passage 50 adapted for alignment with the opening through the nozzle 42. A radially extending annular head 52 is provided at the upper end of the tube 48 to permit seating thereof within mounting collar 54 which surrounds the same and is attached thereto by means of a refractory cement or packing 56. A tube holder guide 58 is detachably connected, as by means of bolts or the like, to the upper flange 62 of the mounting collar 54. The guide 58 as shown in FIG. 11 is an annular member having a stepped axial passage including a lower portion 64 for reception of the tube head 52, an upper portion 66 with a tapered end 67 for reception of the collector nozzle 42 and an intermediate portion 68 that, in the completed assembly, defines a chamber into which an inert gas, such as argon, under pressure is supplied for the purpose of preventing aspiration of air through the juncture between the nozzle 42 and tube 48 into the molten steel. For this purpose, the body of the guide 52 is provided at 69 with a radial opening for connection to an appropriate source (not shown) of inert gas.

The mounting apparatus of the present invention is indicated generally at 70. It comprises a stationary base including a bearing housing 72 having outwardly extending support ribs 74 for attaching the base to a platform or floor 76 adjacent the tundish 10 at about the level of the cover 16 thereof. An upstanding hollow cylindrical post 78 is journaled for rotation in the base by means of bearings 80. A vertically extendable mast 82 is telescopically received in the post 78 for sliding axial movement therein. Atop the mast 82 is attached a cylindrical arm mount 84 that is adapted to retain a tube support arm 86 for both translational and rotary motion. The mount 84 comprises a hollow cylindrical body whose through bore is provided at opposite ends with fixed bushings 88. The mount is recessed at its upper rear end and at its lower front end to accommodate arcuately formed bearing rollers 90 and 92 to assist in supporting the tube support arm 86 for translational movement with respect to the mount 84. As shown, the rollers 90 and 92 may be attached to the mount 84 by means of U-bolts 94 that extend around the exterior of the mount and are secured by nuts 96 to the bearing housings 98 within which the ends of the rollers 90 and 92 are journalled.

The tube support arm 86 which extends substantially perpendicularly from the path of travel of the slide gate tray 34 is an air-cooled member that is here shown as being formed in two detachable hollow pieces 100 and 102. Pieces 100 and 102 are connected by bolts 104 that pass through circumferentially spaced openings in mating flanges 106, 108 on the abutting ends of the respective pieces. Tube support arm piece 102 is a straight member that is received in the bore of the arm mount 84 for both axial sliding and rotational movement therein. The rear end of the piece 102 is closed by a plug 110 that is received within the bore of the piece and welded to the end thereof. Plug 110 contains a central opening through which cooling air inlet tube 112 extends with its discharge end communicating with the internal bore of the piece. Tube 112, at its opposite end, is caused to connect with a source of cooling air through a rotary joint 114.

Tube support arm piece 102 is an angularly offset hollow member that is provided at its end opposite the flange 108 with a tube mount yolk 116. The yolk 116 is a generally U-shaped body provided with a hollow interior defining a cooling air passage that communicates with the internal flow passage of the tube support piece 102. The ends of the yolk body 116 are open at 118 and 120 to accommodate the discharge of cooling air therefrom.

The tube 48 is retained within the yolk 116 by means of a keeper 112 formed by an angle member that extends across the opening formed by the yolk ends and is detachably connected adjacent its ends to brackets 124 weldedly attached each to the respective yolk ends. As shown best in FIG. 4, the components of the yolk 116 are sized to fit loosely between the upper and lower flanges 62 and 63 of the collar 54 and a clearance space is provided between the yolk ends 118, 120 and the exterior of the collar 54 in order to accommodate misalignment between the tube guide 58 and the collector nozzle 42 when the connection is effected. Also, laterally aligned protrusions 125 are provided on the upper surface of each of the yolk legs whereby the tube 48 and mounting collar 54 are permitted to undergo a limited amount of rocking motion when assembled in the yolk.

The pouring tube 48 is capable of being manipulated within the close spacing conditions between the tundish 10 and teeming vessel 12 by its ability to undergo compound movement as a result of the arm mount 84 being able to be extended and retracted with respect to the base 72 and the tube support arm 86 to undergo both axial and rotational movement. Accordingly, up-and-down movement of the arm mount 84 is effected by a fluid-operated mover formed by cylinder 126 that is fixedly attached to the post 78 through mounting bracket 128 and a connecting rod 130 that is pin-connected to the mount through brackets 132.

In manipulating the pouring tube between the tundish 10 and vessel 12, both the translational and rotational movement of the tube support arm 86 is effected manually by the operator through operation of an actuator indicated generally at 134. The actuator 134 comprises an elongated shaft 136 that is slidably and rotatably retained in brackets 138 fixed to arm mount 84. A hand wheel 140 is keyed or otherwise fixed to the rear end of the shaft by means of which the shaft can be pushed or pulled by the workman or rotated thereby. The actuator shaft 136 is connected to the support arm piece 102 by a link 142 formed by sleeves 144 and 146 that are mutually connected by connecting bar 148. Sleeve 144 loosely encircles the tube support arm plug 110 and is retained thereon by a retained plate 150 that is bolted to the plug. Bearing shims or washers 152 are disposed on opposite sides of the sleeve 144 to prevent binding of the sleeve with respect to the plug. Sleeve 146 loosely encircles a stepped down portion of the actuator shaft 136 and is retained thereon by the fixation of the handwheel 140.

Rotation of the tube support arm 86 is effected by means of a pinion 154 keyed to the actuator shaft 136 between the link sleeve 146 and the hand wheel 140. This pinion is caused to mesh with drive gear 156 that is keyed to the retainer plate 150 as by means of dowel pins 158.

Figure 3:
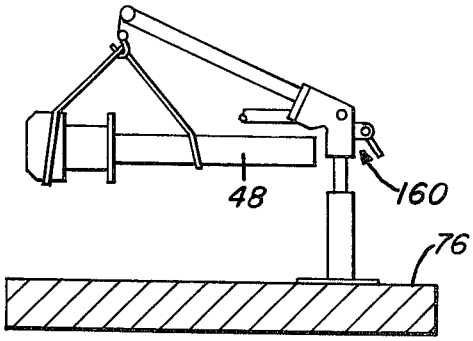
FIG. 3 is an elevational view of a crane utilized in the organization of FIGS. 1 and 2.
Figure 1:
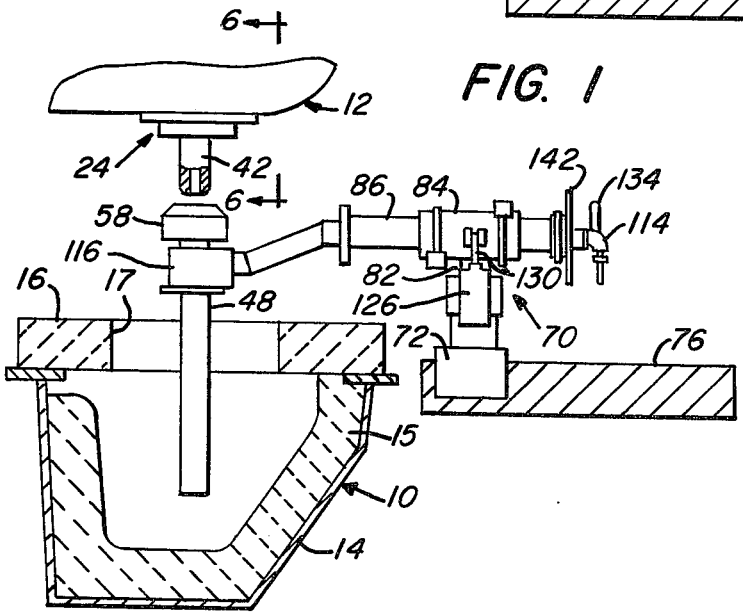
FIG. 1 is an elevational view, partly in section, of a molten metal pouring organization incorporating the pour tube mounting apparatus of the present invention.

The operation of the herein described invention is as follows. With the slide gate valve 24 on the teeming vessel 12 closed and the pouring tube 48 slung from the holding crane 160 as illustrated in FIG. 3, the pour tube mounting apparatus 70 is rotated about its vertical axis by the operator into the position shown in phantom in FIG. 2. The crane 160 is rotated to locate the pour tube collar 54 within the yolk 116. Thereafter, the keeper bar 122 is attached to brackets 124, the tube detached from the crane and the crane rotated away. The operator next rotates the apparatus 70 about its vertical axis past the tundish cover opening 16 and pushes the actuator hand wheel 140 to extend the tube support arm 86 with respect to the mount 84 so as to locate the lower end or tip of the tube 48 over the tundish cover opening 17. The hand wheel 140 is turned to rotate the support arm 86 within the mount 84 and simultaneously therewith the apparatus is manipulated about its vertical axis to angularly lower the tip of the tube through the cover opening 17 and into the tundish interior. Rotation of the support arm 86 continues until the pour tube 48 assumes a vertical position as shown in FIG. 1. The operator next rotates the apparatus 70 about its vertical axis until the guide 58 and the collector nozzle 42 are substantially coaxially aligned whereupon the cylinder 126 of the fluid drive is operated to raise the arm mount 84 and support arm 86 with the attached pour tube 48 whereupon the connection between the pour tube and collector nozzle 42 is made.

It will be appreciated that misalignment between the collector nozzle and the tube guide opening is accommodated by the clearance space between the tube collar 54 and the yolk 116 and the ability of the tube to undergo angular movements in the yolk due to the fact that the upper flange 62 of the collar is rockingly seated on the protrusions 125.

After the connection is made between the pour tube 48 and the gate valve collector nozzle 42, cooling air is supplied to the inlet tube 112 for circulation through the support arm 86 and yolk 116. Thereafter, the gate valve operating motor 36 is actuated to open the valve by moving the tray 34 containing slide plate 38 within the housing 28 until opening 48 in the slide plate is aligned with the opening 32 in the top plate whereupon pouring commences. This movement of the slide plate 38 to which the collector nozzle 42 is attached upon opening or closing of the gate valve is accommodated in the pour tube mounting apparatus 70 by the ability of the support arm 86 to freely undergo angular movement as the post 78 attaching mount 84 rotates within bearings 80. Linear movement of the collector nozzle 42 and the attached pour tube 48 which, in fact, is about six inches in extent, is readily accommodated by angular movement of the support arm 86 due to the larger radius represented by the length of the support arm with respect to the extent of movement of the pour tube as well as the loose connection between the support tube and the yolk.

When it is desired to replace the pour tube 48, the above described steps are performed in reverse sequence.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Means for mounting a pour tube in operative relation to the pour opening in a bottom-pour teeming vessel comprising:

a) a stationary base;

b) vertically extensible and retractable mast means upstanding from said base and rotatable about its longitudinal axis;

c) open ended journal means attached to said mast means adjacent the upper end thereof;

d) an elongated arm received in said journal means for rotation about the longitudinal axis of said arm and for relative axial movement with respect to said journal means, said arm extending outwardly from both ends of said journal means and having means adjacent one end thereof for releasably attaching a pouring tube;

e) means disposed on the opposite side of said journal means from said vessel and engaging the other end of said arm for selectively rotating said arm about its longitudinal axis and for moving said arm axially with respect to said journal means; and f) means for selectively adjusting the axial position of the pouring tube attaching means with respect to said base.

2. The organization recited in claim 1 including means for fluid cooling said arm.

3. The combination as recited in claim 2 in which said arm is formed of hollow tubular members and including means for connecting said members to a source of cooling fluid.

4. The organization recited in claim 1 in which said arm includes means forming a yoke adjacent the free end thereof, and means cooperating with said yoke for releasably clamping a pour tube therein.

5. The organization recited in claim 4 including means on said yoke for providing angular adjustment of said pouring tube with respect to said pour opening.

6. The organization as recited in claim 5 in which said adjustment means comprises arcuate projections formed on the upper edge of said yoke for line contact seating of said pouring tube.

7. The combination as recited in claim 4 in which said pour tube includes means forming a radially extending shoulder for engagement with said yoke, and means effecting relative angular movement between said pour tube and said arm.

8. The combination as recited in claim 7 in which said angular movement effecting means including means for pivotably seating said pour tube on said yoke.

9. The combination as recited in claim 8 in which said pour tube seating means comprises fulcrum projections disposed on said yoke for engagement with said pour tube shoulder.

10. The organization recited in claim 1 in which said mast means includes a cooperating cylinder and post, one of said members being mounted in said base and the other attaching said journal means, and means for selectively adjusting the height of said mast means with respect to said base.

11. The organization recited in claim 10 in which said height adjusting means comprises a fluid motor operatively connected between said cylinder and said post.

12. The combination as recited in claim 1 including a slide gate valve operatively interposed between the pour opening in said teeming vessel and said pour tube and in which said slide gate valve includes a downwardly depending nozzle and said pour tube includes upwardly extending guide means forming the connection between said pour tube and said nozzle.

13. The combination as recited in claim 12 in which said guide means comprises:

a) an annular body having an axial opening therethrough;

b) means for disposing the lower end of said opening in surrounding relation to the upper end of said pour tube; and c) means for disposing the upper end of said opening in surrounding relation to said nozzle.

14. The combination as recited in claim 13 in which the opening in said guide means includes means forming an annular plenum about the juncture between said pour tube and said nozzle; and means for supplying pressurized inert gas to said plenum.

15. Means for mounting a pour tube in operative relation to the pour opening in a bottom-pour teeming vessel comprising:

a) a stationary base disposed remote from said teeming vessel;

b) mast means upstanding from said base having a longitudinal axis in laterally spaced relation to said pour opening, and said mast means being extensible and retractable along said longitudinal axis and rotatable thereabout;

c) open ended journal means attached to said mast means adjacent the upper end thereof, the axis of said journal means being substantially normal to the axis of said mast means;

d) an elongated arm coaxially disposed in said journal means for rotation about the longitudinal axis thereof and for relative axial movement with respect thereto, said arm having means adjacent one end for releasably mounting a pour tube with its axis substantially parallel to the axis of said pour opening;

e) means for imparting compound movement to said pour tube including means for rotating said arm within said journal means and for moving said arm axially with respect thereto; and f) means for selectively adjusting the axial position of the pour tube mounting means with respect to said pour opening.

* * * * *